US008378909B2

(12) United States Patent
Sato et al.

(10) Patent No.: US 8,378,909 B2
(45) Date of Patent: Feb. 19, 2013

(54) ANTENNA AND WIRELESS COMMUNICATION APPARATUS

(75) Inventors: Jin Sato, Beijing (CN); Yuji Kaminishi, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 435 days.

(21) Appl. No.: 12/548,753

(22) Filed: Aug. 27, 2009

(65) Prior Publication Data

US 2009/0303140 A1 Dec. 10, 2009

Related U.S. Application Data

(63) Continuation of application No. PCT/JP2008/056467, filed on Apr. 1, 2008.

(30) Foreign Application Priority Data

Apr. 5, 2007 (JP) ..... 2007-099579

(51) Int. Cl.
*H01Q 1/24* (2006.01)
*H01Q 19/00* (2006.01)

(52) U.S. Cl. ..... 343/725; 343/702; 343/833

(58) Field of Classification Search ..... 343/700 MS, 343/702, 833, 725
See application file for complete search history.

(56) References Cited

U.S. PATENT DOCUMENTS

| | | | | |
|---|---|---|---|---|
| 4,907,006 | A * | 3/1990 | Nishikawa et al. | 343/700 MS |
| 6,614,401 | B2 * | 9/2003 | Onaka et al. | 343/702 |
| 2002/0145569 | A1 | 10/2002 | Onaka et al. | |
| 2005/0128162 | A1 * | 6/2005 | Takagi et al. | 343/895 |
| 2005/0190107 | A1 | 9/2005 | Takagi et al. | |
| 2005/0275596 | A1 * | 12/2005 | Harano | 343/702 |
| 2006/0017621 | A1 * | 1/2006 | Okawara et al. | 343/700 MS |
| 2007/0057849 | A1 | 3/2007 | Moon et al. | |

FOREIGN PATENT DOCUMENTS

| | | | |
|---|---|---|---|
| EP | 1 860 732 | A1 | 11/2007 |
| JP | 06-303021 | A | 10/1994 |
| JP | 2002-252515 | A | 9/2002 |
| JP | 2002-314330 | A | 10/2002 |
| JP | 2002-344222 | A | 11/2002 |
| JP | 2002-368535 | A | 12/2002 |
| JP | 2004-274445 | A | 9/2004 |
| JP | 2005-244553 | A | 9/2005 |
| JP | 2007-049249 | A | 2/2007 |
| JP | 2007-082170 | A | 3/2007 |
| WO | 2006/098089 | A1 | 9/2006 |

OTHER PUBLICATIONS

Official Communication issued in International Patent Application No. PCT/JP2008/056467, mailed on Jul. 8, 2008.
Official Communication issued in corresponding Japanese Patent Application No. 2009-509261, mailed on Apr. 3, 2012.

* cited by examiner

*Primary Examiner* — Robert Karacsony
(74) *Attorney, Agent, or Firm* — Keating & Bennett, LLP

(57) ABSTRACT

In an antenna, a first type radiation electrode and a second type radiation electrode are provided on the surface of a dielectric base, which has a predetermined external shape, or embedded in the dielectric base. The first type radiation electrode is provided with an open terminal at one end thereof and a feeding terminal at the other end thereof so as to constitute a monopole type antenna. The second type radiation electrode is provided with a capacitive-coupling feeding electrode at one end thereof and a ground connection terminal at the other end thereof so as to constitute a capacitive feed antenna. The one end of the first type radiation electrode is located opposite to the feeding electrode of the second type radiation electrode when viewed in the direction of the length of the dielectric base.

7 Claims, 7 Drawing Sheets

ANTENNA AND WIRELESS COMMUNICATION APPARATUS

BACKGROUND OF THE INVENTION

1. Field of the Invention

The present invention relates to an antenna for use in, for example, a wireless communication apparatus such as a mobile communication device or other suitable apparatus. In addition, the present invention relates to a wireless communication apparatus that includes such an antenna.

2. Description of the Related Art

An antenna that is used in a plurality of frequency bands in a wireless communication apparatus such as the terminal device (i.e., mobile phone) of a mobile phone system or the like is described in Japanese Unexamined Patent Application Publication No. 2005-244553 and Japanese Unexamined Patent Application Publication No. 2002-252515. FIG. 1 is a diagram that illustrates the configuration of an antenna that is described in the Japanese Unexamined Patent Application Publication No. 2005-244553. As shown in FIG. 1, an antenna 13 includes a first antenna element 11 and a second antenna element 12 arranged adjacently with respect to a ground plate 8. The first antenna element 11 resonates at a first frequency. The second antenna element 12 resonates at a second frequency. The first antenna element 11 is connected to a first feeding point 14 that is provided on the ground plate 8. One end of a first matching circuit 16 is connected to the first feeding point 14. The other end of the first matching circuit 16 is connected to a connection point 18.

On the other hand, the second antenna element 12 is connected to a second feeding point 15 that is provided on the ground plate 8. One end of a second matching circuit 17 is connected to the second feeding point 15. As in the connection provided for the first antenna element 11, the other end of the second matching circuit 17 is connected to the connection point 18. The connection point 18 is connected to a wireless circuit 7 via a transmission line 6. These components make up a wireless apparatus 19.

The first matching circuit 16 is made up of an inductor 20. The second matching circuit 17 is made up of a capacitor 22 and an inductor 21.

FIG. 2 is a perspective view that illustrates the configuration of an antenna that is described in the Japanese Unexamined Patent Application Publication No. 2002-252515. The illustrated antenna includes two mono antennae 32 and 33 that are arranged in parallel with each other and in the proximity of each other on the surface of an antenna substrate 31. Dielectric substrates 34 and 35 are used as the base substances of the mono antennae 32 and 33, respectively. A strip of radiation electrode 36, 37 is formed on one main surface (e.g., front surface) of each dielectric substrate 34, 35. Except for the periphery of a feeding electrode 39, a ground electrode is formed on the entire region of the other main surface (e.g., rear surface) of each dielectric substrate 34, 35 (it should be noted that the same feeding electrode as the illustrated feeding electrode 39 is formed on the mono antenna 32 though it is not shown therein). A side surface ground electrode 42 is provided on a side surface of each dielectric substrate 34, 35 that extends in the direction of the length thereof (it should be noted that the same side surface ground electrode as the illustrated side surface ground electrode 42 is formed on the mono antenna 33 though it is not shown therein). The two mono antennae 32 and 33 are arranged in such an orientation that these two side surfaces on which these two side surface ground electrodes are arranged face each other. The feeding electrode is connected to the radiation electrode 36, 37 via capacitance therebetween.

However, in the configuration in which two direct feed-type ungrounded mount antennae are used while being fed independently of each other as illustrated in FIG. 1, the problem of interference arises between one of the two direct-feeding non-ground mount antennae and the other. Because of such an interference problem, it is not practically possible to obtain the combined characteristics of one individual direct-feeding non-ground mount antenna and the other individual direct-feeding non-ground mount antenna.

Moreover, if side surface ground electrodes are provided in order to prevent interference from occurring between two mono antennae that are arranged adjacent to each other as illustrated in FIG. 2, the Q value of the antenna increases, which narrows the band characteristics thereof.

SUMMARY OF THE INVENTION

In view of the foregoing, preferred embodiments of the present invention provide an antenna that makes it possible to reduce interference between a plurality of antenna parts, ensure satisfactory antenna characteristics required for mono antennae in a plurality of respective frequency bands, and achieve a smaller antenna size. Preferred embodiments of the present invention also provide a wireless communication apparatus that includes such a novel antenna.

An antenna according to a preferred embodiment of the present invention includes a dielectric base that has a predetermined external shape; and at least two types of radiation electrodes that include a first type radiation electrode that is provided on the surface of the dielectric base or embedded in the dielectric base and a second type radiation electrode that is provided on the surface of the dielectric base or embedded in the dielectric base, the first type radiation electrode being provided with an open terminal at one end of the first type radiation electrode and a feeding terminal at the other end of the first type radiation electrode so as to constitute a monopole type antenna, the second type radiation electrode being provided with a capacitive-coupling feeding electrode at one end of the second type radiation electrode and a ground connection terminal at the other end of the second type radiation electrode so as to constitute a capacitive feed antenna, wherein the one end of the first type radiation electrode is located opposite to the feeding electrode of the second type radiation electrode when viewed in the direction of the length of the dielectric base.

Generally speaking, when antenna parts for different systems having a plurality of feeding lines are located near each other, isolation is a major problem. As an approach for ensuring good isolation, it is effective to sufficiently space out and distance one antenna part from the other. However, such an approach has a problem in that physical volume occupied by such an antenna increases. Alternatively, if the distance between one antenna part and the other is made greater without changing the volume thereof, the physical volume of each antenna part decreases, which results in a decrease in antenna efficiency.

In contrast, in the configuration of an antenna according to a preferred embodiment of the present invention described above, the first type radiation electrode constitutes a monopole type antenna, whereas the second type radiation electrode constitutes a capacitive feed antenna. Since the capacitive feed antenna that includes the second type radiation electrode has a high antenna Q value, it is possible to ensure sufficient isolation, which is advantageous.

In addition, since the one end (i.e., open terminal/end) of the first type radiation electrode is located opposite to the feeding electrode (i.e., open end) of the second type radiation electrode when viewed in the direction of the length of the dielectric base, it is possible to ensure good isolation between one antenna part and the other. Alternatively, in other words, it is possible to ensure good isolation between one antenna part and the other because the open end of the first type radiation electrode and the open end of the second type radiation electrode are distanced from each other by the maximum available distance value. A monopole antenna has a property that the radiation efficiency thereof improves if the feeding point thereof is provided at an end position. However, if the feeding point is provided at an end position, a longer feeder line is required, which increases loss.

In contrast, in the configuration of an antenna according to a preferred embodiment of the present invention described above, the feeding point of an antenna that is made of the second type radiation electrode (i.e., capacitive feed antenna) is provided at the near side whereas the contact thereof to a ground is provided at an end of a mount board. Since such a structure decreases the length of a feeder line, it is possible to reduce feeder-line loss. Moreover, it is possible to integrate two types of antennae provided for communication systems different from each other into one body and to improve the positional accuracy between these two types of antennae, thereby making it further possible to offer stable characteristics. Furthermore, it is possible to reduce assembly cost and mounting cost.

A plane on which the open terminal of the first type radiation electrode is provided may not be the same as a plane on which the open end of the second type radiation electrode is provided. With such a structure, it is possible to lengthen the distance between the maximum electric field point of the first type radiation electrode and the maximum electric field point of the second type radiation electrode. For this reason, it is possible to achieve good isolation between the first type radiation electrode and the second type radiation electrode.

The cross section of the dielectric base that is taken along a vertical plane with respect to the direction of the length of the dielectric base may have the shape of, roughly or substantially, a capital L, or may form, roughly or substantially, an L-shaped part.

With such a structure, it is possible to make the dielectric base compatible with the various shapes of a variety of wireless communication apparatuses such as cellular phone and the like, which is advantageous.

The first type radiation electrode may be provided with a ground connection electrode (i.e., grounding conductor) for matching; and an end of the matching ground connection electrode may be connected to the ground connection terminal of the second type radiation electrode.

With such a structure, it is possible to eliminate a need to provide any additional and dedicated ground electrode for the purpose of connecting the matching ground connection electrode to a ground. Since it is not necessary to provide any additional and dedicated ground electrode for the purpose of connecting the matching ground connection electrode to a ground, it is possible to make the entire size of the antenna much smaller than previously possible. Moreover, the structure of the mounting of the antenna onto a mount target board is simplified.

The first type radiation electrode may be made up of two radiation electrodes that share the feeding terminal and have lengths different from each other, for example.

In such a structure, the first type radiation electrode functions as an antenna part that is used in two frequency bandwidths. In addition to the second type radiation electrode that functions as an antenna part that is used in another frequency bandwidth, it is possible to use the antenna in three frequency bandwidths.

The dielectric base may constitute a portion of the frame of a wireless communication apparatus on which the antenna is provided or a portion of a structural body that is formed inside the frame of a wireless communication apparatus on which the antenna is provided.

With such a structure, it is possible to ensure a large physical volume occupied by an antenna that is made of the first type radiation electrode and a large physical volume occupied by an antenna that is made of the second type radiation electrode; and, in addition thereto, it is possible to reduce the number of parts or components. Therefore, it is possible to achieve a wireless communication apparatus that is equipped with an antenna featuring a small size and a high gain.

A wireless communication apparatus according to another preferred embodiment of the present invention includes the antenna having any of the configurations described above and a wireless communication circuit arranged to perform feeding via the feeding terminal and the capacitive-coupling feeding electrode.

The wireless communication apparatus may further include a matching circuit in a feeder circuit that is arranged to feed the capacitive-coupling feeding electrode, where, in such a configuration, an antenna that is made of the second type radiation electrode is allocated to a wireless communication system that performs communications in a frequency bandwidth that is narrower than that of an antenna that is made of the first type radiation electrode.

With such a structure, it is possible to use the antenna that is made of the second type radiation electrode for a narrow band and high gain system, thereby boosting the overall performance thereof.

According to a preferred embodiment of the present invention, it is possible to reduce the size of an antenna while isolating at least two types of radiation electrodes that are made up of a first type radiation electrode and a second type radiation electrode from each other and to increase the positional precision of the antenna with respect to a board. Therefore, an antenna that makes it possible to ensure satisfactory antenna characteristics required of mono antennae in a plurality of respective frequency bands while offering a smaller antenna size is provided. In addition, a wireless communication apparatus that is equipped with such an antenna is provided.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

Figure 1:
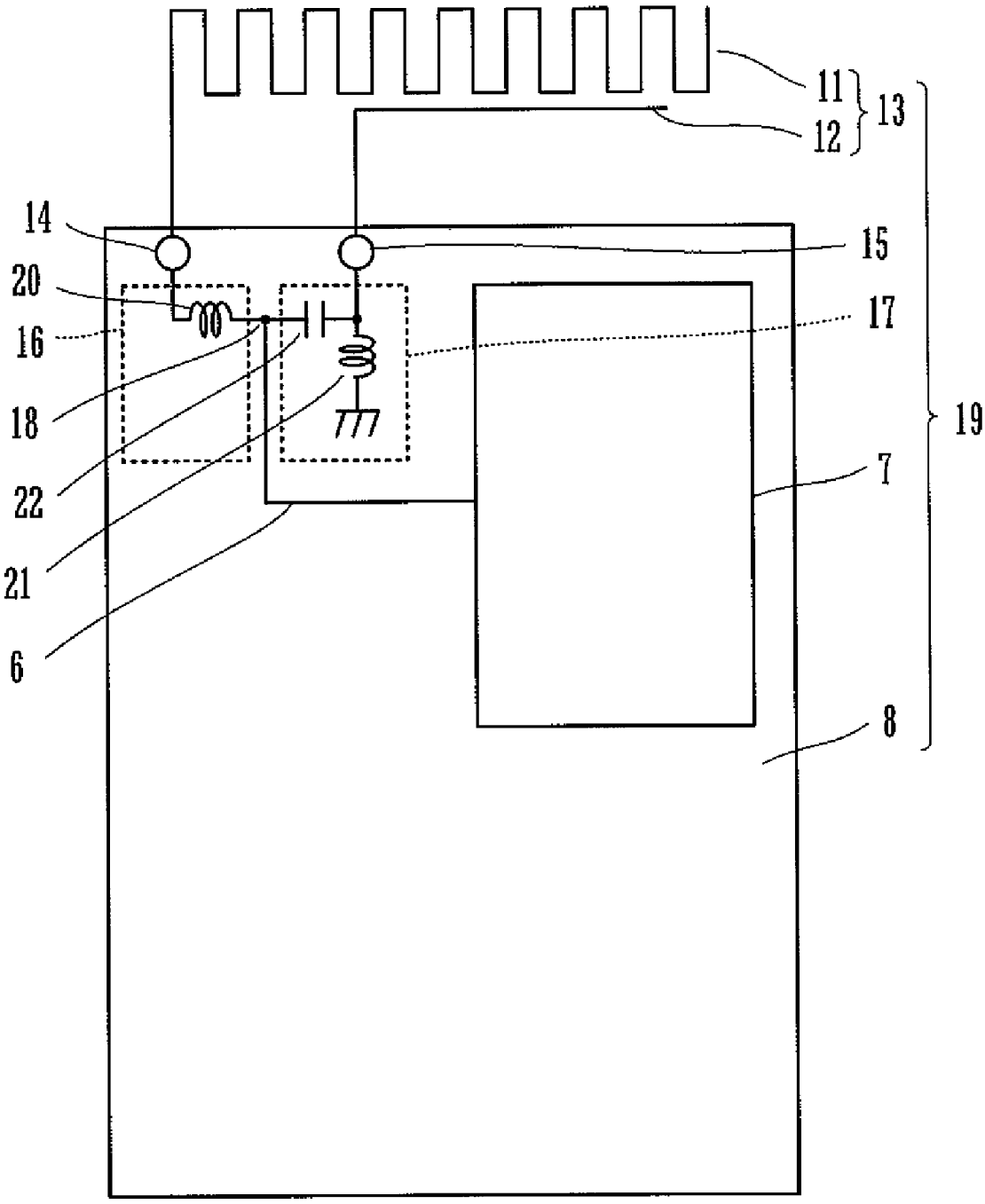
Fig.1 Prior Art
FIG. 1 is a diagram that illustrates the configuration of an antenna that is described in the Japanese Unexamined Patent Application Publication No. 2005-244553.
Figure 2:
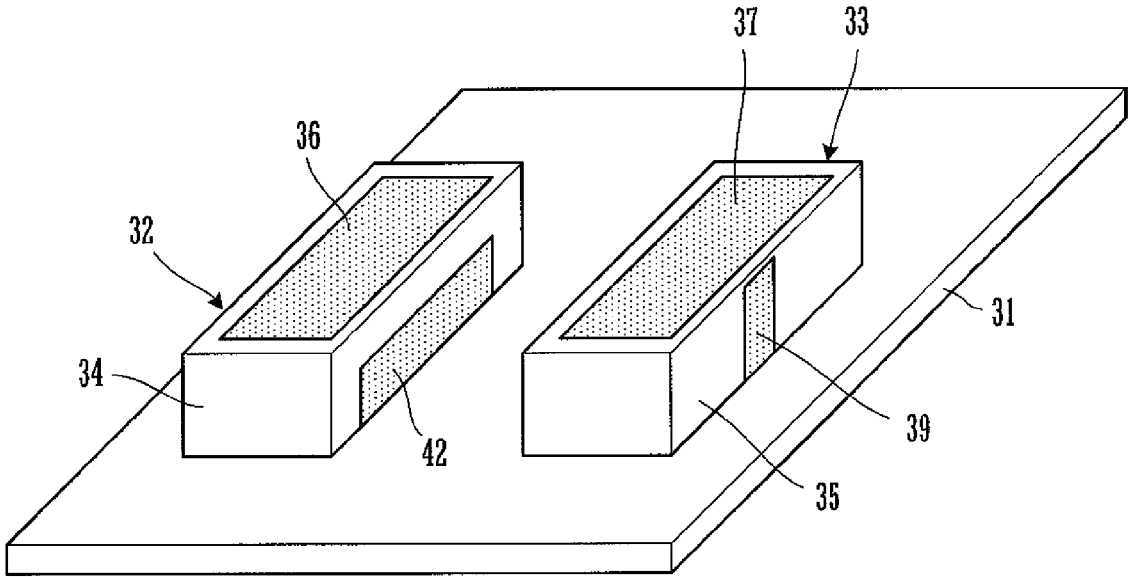
Fig.2 Prior Art
FIG. 2 is a diagram that illustrates the configuration of an antenna that is described in the Japanese Unexamined Patent Application Publication No. 2002-252515.
Figure 3A:
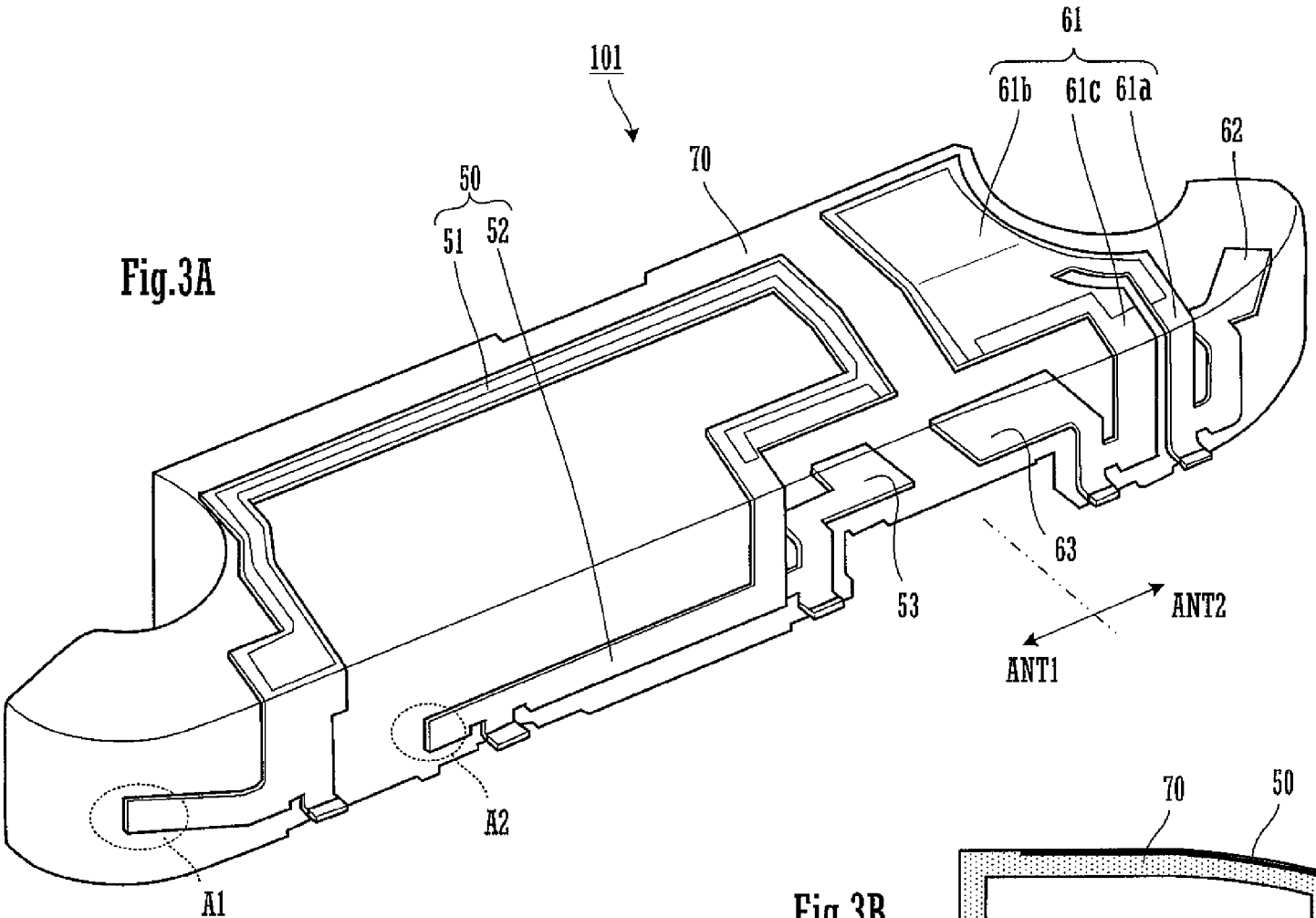
FIG. 3A is a perspective view and FIG. 3B is a cross-sectional view that schematically illustrate the configuration of an antenna according a first preferred embodiment of the present invention.
Figure 3B:
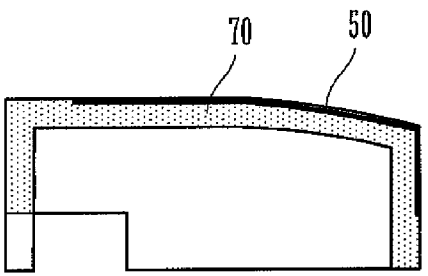
Figure 4:
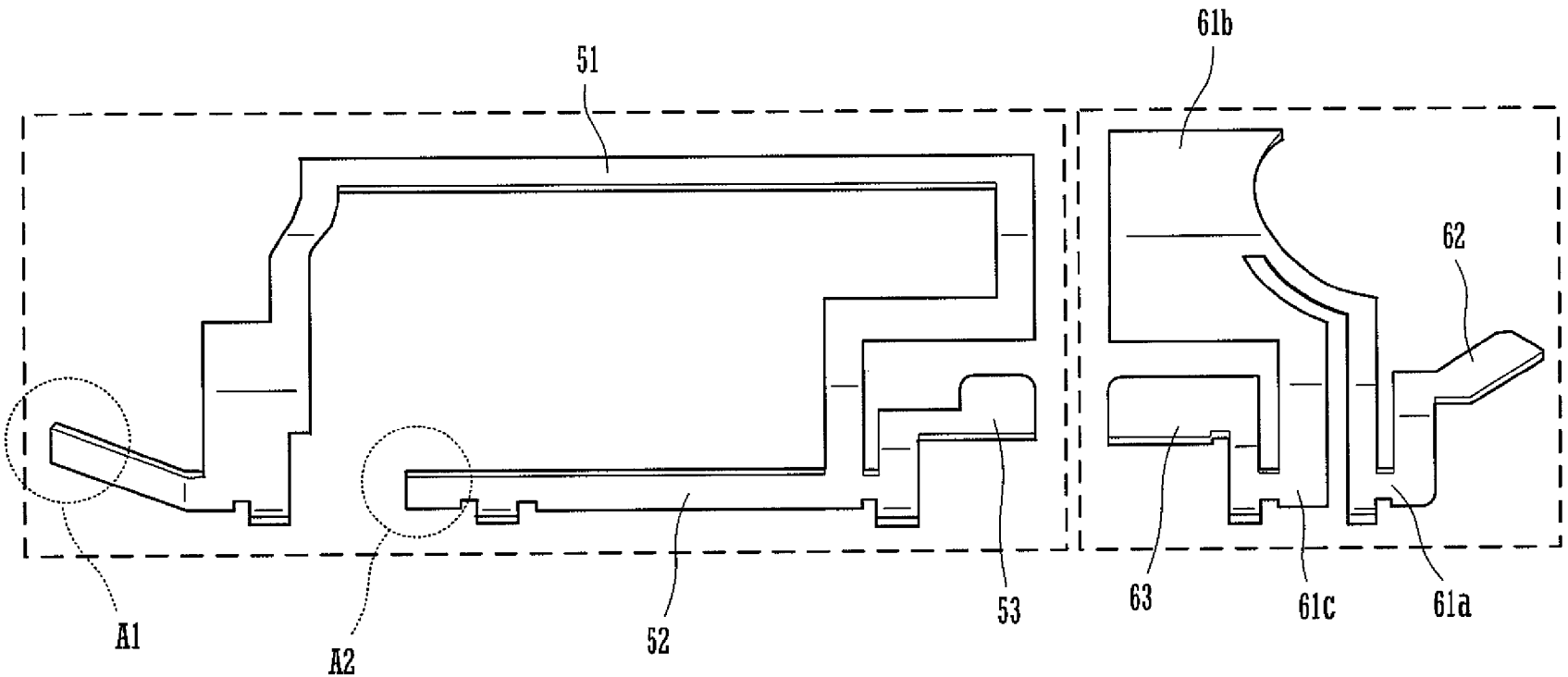
FIG. 4 is a partial view that schematically illustrates the configuration of the conductor portion and the electrode portion of an antenna according to the first preferred embodiment of the present invention.

FIG. 3A is a perspective view that schematically illustrates the configuration of an antenna according a first preferred embodiment of the present invention. FIG. 3B is a cross-sectional view that schematically illustrates the configuration of the center portion thereof. FIG. 4 is a partial view that schematically illustrates the configuration of the conductor portion and the electrode portion of the antenna illustrated in FIG. 3A and FIG. 3B. In FIG. 3A, an antenna 101 preferably includes a dielectric base 70 as well as conductors and electrodes. The dielectric base 70 has a predetermined shape. The electrodes and conductors that have a predetermined pattern are formed in/on the dielectric base 70. The dielectric base 70 constitutes a portion of a structural body that is formed inside the frame of a wireless communication apparatus on which the antenna 101 is provided. Therefore, the entire shape of the dielectric base 70 is formed in such a manner that it can be fittingly built in as a part thereof inside the frame of a wireless communication apparatus.

In the molding production of the antenna 101, a resin material that has a high dielectric constant (e.g., a resin with the mixture of dielectric ceramic powder) is insertion molded on the conductors and electrodes having a predetermined shape that is shown in FIG. 4. The antenna 101 is an integrated antenna that preferably includes a first antenna portion ANT1 and a second antenna portion ANT2. The first antenna portion ANT1 includes a first type radiation electrode. The second antenna portion ANT2 includes a second type radiation electrode.

Two radiation electrodes 51 and 52 are provided in the first antenna portion ANT1. One end A1 of the radiation electrode 51 preferably is an open end. A feeding terminal 53 is provided at the other end of the radiation electrode 51. Similarly, one end A2 of the radiation electrode 52 is an open end, whereas the other end thereof is a feeding terminal 53 end. A spring terminal for electric connection that is provided on a mount board is in contact with the feeding terminal 53. A feeding circuit that is provided on the mount board feeds voltage to the first antenna portion ANT1 through this contact connection. Each radiation electrode 51, 52 functions as a monopole antenna. The feeding terminal 53 functions as a common feeding terminal that is shared by these two radiation electrodes 51 and 52. Accordingly, the shared feeding terminal 53 feeds each of the two radiation electrodes 51 and 52.

A second type radiation electrode 61 is included in the second antenna portion ANT2. The second type radiation electrode 61 of the second antenna portion ANT2 is provided with a capacitive-coupling feeding electrode 62 at one end and a ground connection terminal 63 at the other end. The second type radiation electrode 61 is made up of radiation electrode elements 61*a*, 61*b*, and 61*c*. The radiation electrode element 61*a* extends from the feeding electrode 62 to the near/proximal side surface, that is, the surface of this side, of the dielectric base 70 and further extends from the near side surface of the dielectric base 70 to the upper surface thereof. The radiation electrode element 61*b* stretches in a certain area on the upper surface of the dielectric base 70 as a planar radiation electrode element. The radiation electrode element 61*c* extends from the planar radiation electrode element 61*b* to the near side surface of the dielectric base 70 and further extends from the near side surface of the dielectric base 70 to the ground connection terminal 63. As explained above, since a portion of the second type radiation electrode 61 is formed as a planar radiation electrode element that stretches in a certain area, the antenna 101 has a sufficient antenna volume so as to achieve greater antenna efficiency than otherwise. Note that a plane on which the feeding electrode 62 is provided is not the same as a plane on which the open end A1 of the first type radiation electrode 50 is provided. In addition, a plane on which the feeding electrode 62 is provided is not the same as a plane on which the open end A2 of the first type radiation electrode 50 is provided.

A capacitance is formed between the feeding electrode 62 and a capacitive feeding electrode that is provided on the mount board. A feeding circuit that is provided on the mount board feeds voltage thereto via capacitive feeding. A spring terminal for ground connection that is provided on the mount board is in contact with the ground connection terminal 63. Accordingly, the ground connection terminal 63 is grounded. A ground electrode is provided on the reverse surface of the mount board at a region opposite to the second type radiation electrode 61. Therefore, the second antenna portion ANT2 operates as a grounded mount type capacitive feed antenna.

Each open end (A1, A2) of the first type radiation electrode 50 is located at one-end side of the dielectric base 70 viewed in the direction of the length thereof whereas the feeding electrode 62 of the second type radiation electrode 61 is located at the other-end side of the dielectric base 70 viewed in the direction of the length thereof, which is opposite to the one-end side thereof. That is, the maximum electric field points of two antennae are distanced from each other by the maximum distance value that is structurally available. In addition, each plane on which the open end (A1, A2) of the first type radiation electrode 50 is provided is not the same as a plane on which the feeding electrode 62 is provided. Because of these reasons, it is possible to significantly reduce interference that is caused by electric field and thus to achieve sufficient isolation between the first antenna portion ANT1 and the second antenna portion ANT2. Therefore, it is possible to ensure satisfactory antenna characteristics both for the first antenna portion ANT1 as an antenna unit and for the second antenna portion ANT2 as another antenna unit.

Moreover, although two antennae that are fed independently of each other are arranged near each other, no ground electrode is provided between the two radiation electrodes thereof, unlike the related-art configuration described in the Japanese Unexamined Patent Application Publication No. 2002-252515. Therefore, the problem of an increase in the Q value of the antenna and the resultant narrow band characteristics thereof does not arise.

As explained above, since it is possible to secure sufficient isolation between the first antenna portion ANT1 and the second antenna portion ANT2 and make it unnecessary to leave a large space between one radiation electrode and the other, the overall size of the antenna can be reduced.

Furthermore, since two or more radiation electrodes that have input lines different from each other or one another are integrated into one body, their positional variation is compensated as a single antenna, which improves location accuracy at the time of the mounting thereof on a mount board.

In addition, since the feeding electrode 62 of the second antenna portion ANT2 is preferably positioned at the inner side of the mount board, it is possible to make the length of a feeder line shorter in comparison with a case where the feeding electrode 62 of the second antenna portion ANT2 is positioned at the end of the mount board. Consequently, it is possible to reduce loss at the feeder line that occurs in a case where the feeder line has a longer wiring pattern.

As illustrated in FIG. 3B, the cross section of the dielectric base 70 that is taken along a vertical plane with respect to the direction of the length of the dielectric base 70 has the shape of, roughly or substantially, a capital L, or forms, roughly or substantially, an L-shaped portion. Since the dielectric base 70 has such a structure, it is possible not only to offer effective a base material portion that defines the first type radiation electrode 50 and the second type radiation electrode 61 but also to make itself compatible with the various shapes of a variety of wireless communication apparatuses such as cellular phone and the like. That is, in comparison with a case where the dielectric base 70 has a solid structure, the structure explained above offers greater device-mount structure flexibility and design flexibility. Furthermore, since the dielectric constant between a ground electrode that is formed on the mount board and the second type radiation electrode 61 as well as between the ground electrode that is formed on the mount board and the first type radiation electrode 50 is low, the first type radiation electrode 50 and the second type radiation electrode 61 are electrically independent of the mount board, which makes design easier.

Figure 5:
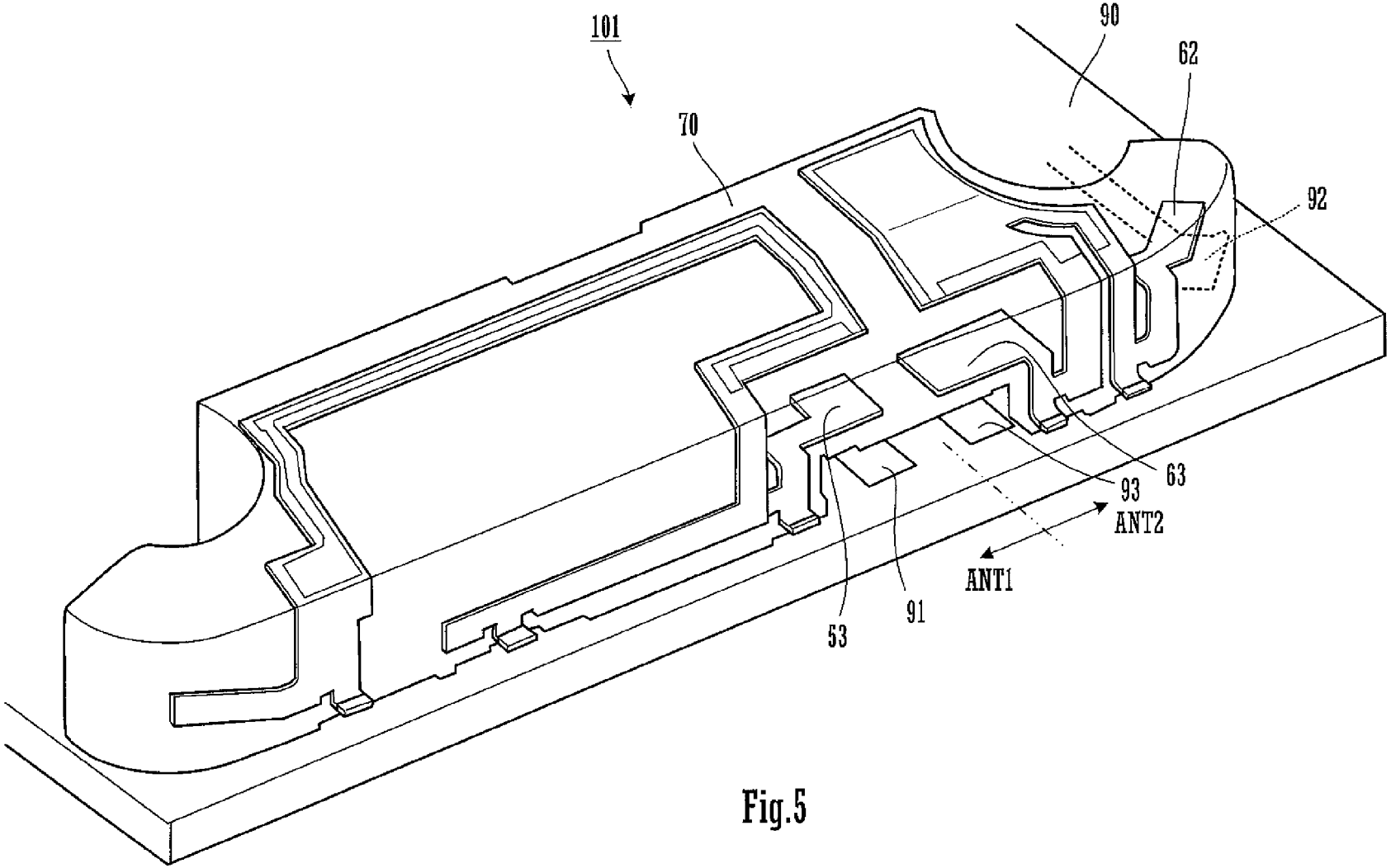
FIG. 5 is a diagram that schematically illustrates the positional relationship between an antenna according to the first preferred embodiment of the present invention and a mount board in an antenna-mount state in which the antenna is mounted as a component of a wireless communication apparatus.

FIG. 5 is a diagram that schematically illustrates the configuration of antenna parts built as a component of a wireless communication apparatus. Specifically, FIG. 5 shows an antenna mount state in which the antenna 101 illustrated in FIGS. 3 and 4 is mounted on a mount board 90. A board-side feeding terminal 91, a board-side feeding electrode 92, and a board-side ground terminal 93 are provided on the mount board 90. The feeding terminal 53 of the antenna 101 is "directly" connected to the board side feeding terminal 91 of the mount board 90 with a spring terminal being interposed therebetween. The ground connection terminal 63 of the antenna 101 is directly connected to the board side ground terminal 93 of the mount board 90 with a spring terminal being interposed therebetween. On the other hand, the feeding electrode 62 of the antenna 101 is embedded in the dielectric base 70 thereof. Accordingly, the feeding electrode 62 of the antenna 101 is provided opposite to the board-side feeding electrode 92 of the mount board 90 with a certain distance being formed therebetween. Capacitive feeding is performed with such a structure.

No ground electrode is provided on the mount board 90 at a region opposite to the first antenna portion ANT1. On the other hand, a ground electrode is provided on the reverse surface of the mount board 90 at a region opposite to the second antenna portion ANT2. Therefore, the first antenna portion ANT1 functions as a non-ground mount antenna, whereas the second antenna portion ANT2 functions as a ground mount antenna.

Figure 6:
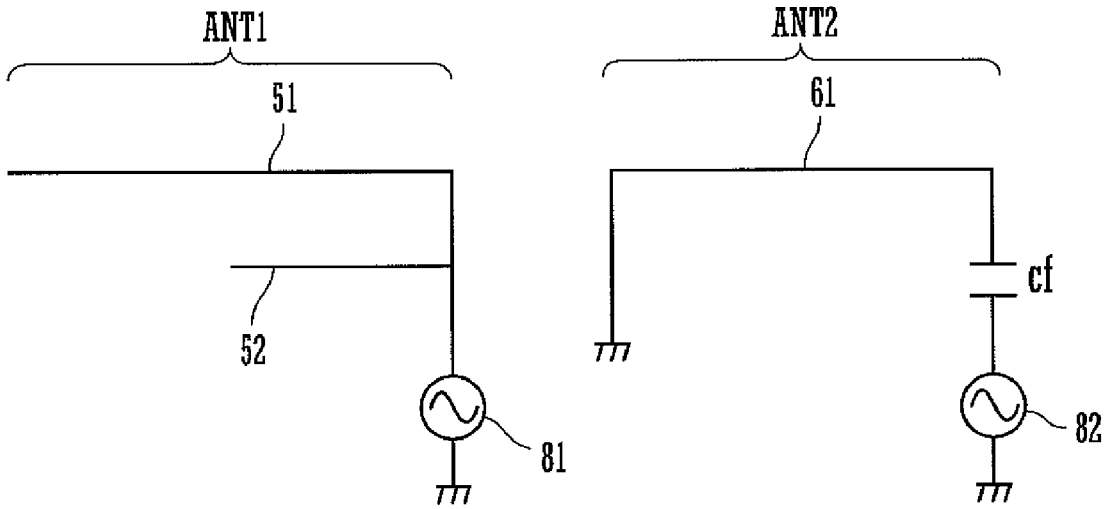
FIG. 6 is an equivalent circuit diagram of an antenna according to the first preferred embodiment of the present invention.

FIG. 6 is an equivalent circuit diagram of an antenna according to the first preferred embodiment of the present invention. As illustrated therein, the first antenna portion ANT1 functions as a pair of monopole antennae according to which each of the first radiation electrode 51 and the second radiation electrode 52 thereof is directly fed from a feeder circuit 81 of a wireless communication circuit. On the other hand, the second antenna portion ANT2 functions as a capacitive feed antenna according to which a feeder circuit 82 of a wireless communication circuit feeds voltage to the second type radiation electrode 61 via a feed capacitance Cf through capacitive feeding.

In FIG. 6, an antenna including the first radiation electrode 51 of the first antenna portion ANT1 is used for performing communications in a CDMA 800 (e.g., approximately 843 MHz-890 MHz) wireless communication system. An antenna that includes the second radiation electrode 52 of the first antenna portion ANT1 is used for performing communications in a CDMA 2000 (e.g., approximately 1920 MHz-2130 MHz) wireless communication system. On the other hand, the second antenna portion ANT2 is used as an antenna for a GPS (approximately 1575 MHz) wireless communication system. In the illustrated configuration, the feed capacitance Cf is embodied as a matching circuit of a feeding circuit that feeds voltage to the feeding electrode 62. The impedance of capacitive feeding is matched (that is, the inductance of an antenna is reduced whereas the capacitance is increased) with the use of the capacitance of the feed capacitor Cf, thereby increasing the Q value of the antenna. Though the bandwidth of the antenna narrows as the Q value thereof increases, antenna efficiency is improved. As a result, the antenna can be used as high-gain antenna in a narrow band system such as GPS.

Second Preferred Embodiment

Figure 7:
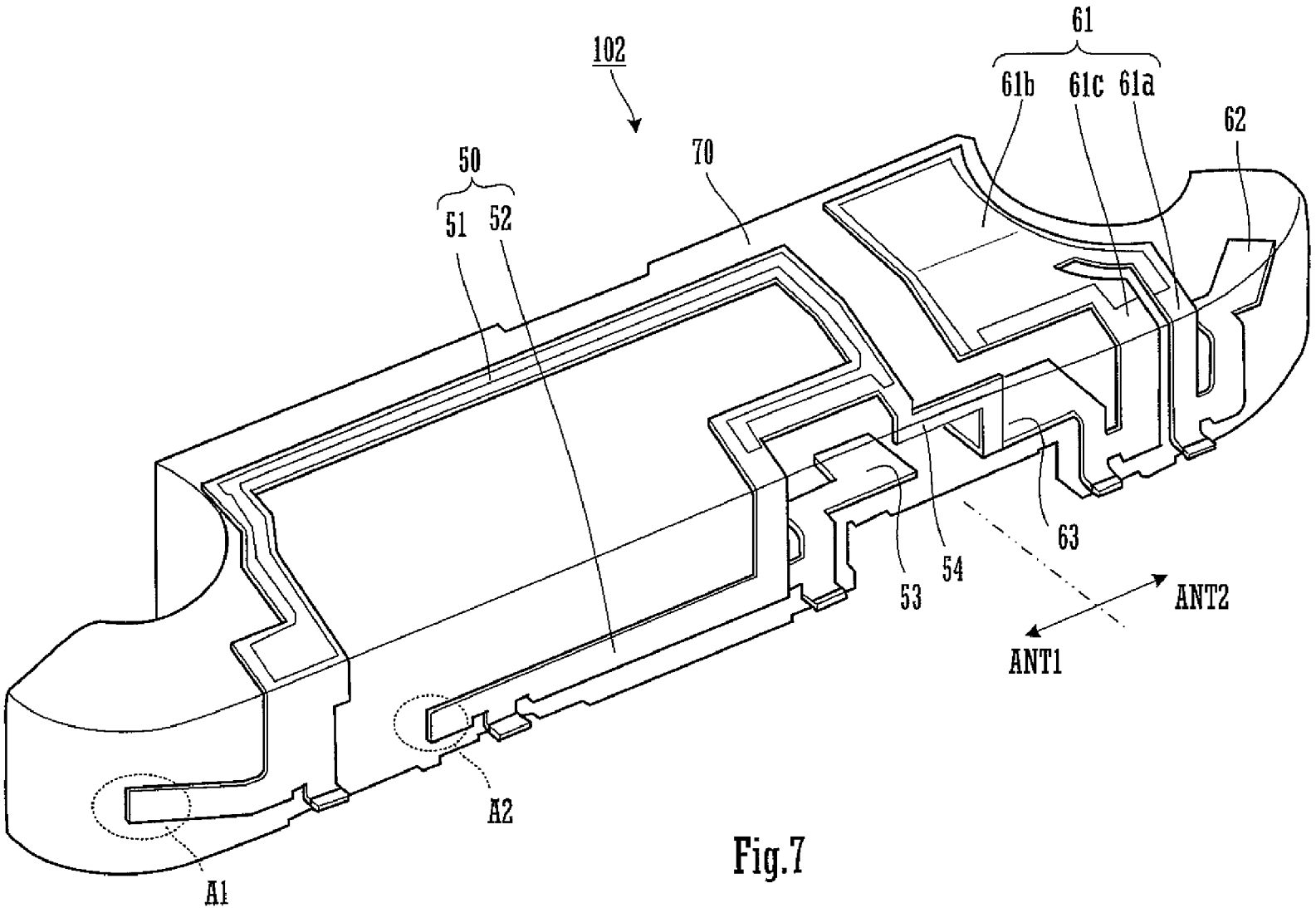
FIG. 7 is a perspective view that schematically illustrates the configuration of an antenna according a second preferred embodiment of the present invention.

FIG. 7 is a perspective view that schematically illustrates the configuration of an antenna 102 according to a second preferred embodiment of the prevent invention. The configuration of the antenna 102 according to the second preferred embodiment of the present invention explained below differs from that of the antenna 101 according to the foregoing first preferred embodiment of the present invention, which is illustrated in FIG. 3, in that the first antenna portion ANT1 of the antenna 102 according to the second preferred embodiment of the present invention is provided with a matching ground connection electrode whereas the first antenna portion ANT1 of the antenna 101 according to the foregoing first preferred embodiment of the present invention is not provided with such an electrode. Specifically, as illustrated in FIG. 7, a matching ground connection conductor 54 is provided between a region of the first antenna portion ANT1 and the ground connection terminal 63 of the second antenna portion ANT2. The region mentioned above is located en route on a path from the feeding terminal 53 of the first antenna portion ANT1 to the first radiation electrode 51 thereof. Since the antenna 102 according to the second preferred embodiment of the present invention is provided with the matching ground connection conductor 54, it is possible to reduce return loss in a predetermined frequency band of the antenna thanks to the impedance matching of the first radiation electrode 51, which improves antenna efficiency. In addition, since the ground connection terminal 63 of the second antenna portion ANT2 is shared, it is not necessary to provide any additional and dedicated ground connection terminals for the purpose of connecting the matching ground connection conductor 54 to a ground. For this reason, it is possible to reduce the number of contacts that are necessary for the mounting of the antenna 101.

Moreover, a short circuit offered by the matching ground connection conductor 54 is positioned in the neighborhood of an end of a mount board. Accordingly, the length of the board is equivalently great, which results in the enhanced radiation efficiency characteristics of the first antenna portion ANT1.

In each of the foregoing exemplary preferred embodiments of the present invention, it is explained that some portion of the first type radiation electrode 50 and the second type radiation electrode 61 is exposed on the surface of the dielectric base 70 whereas the other portion of the first type radiation electrode 50 and the second type radiation electrode 61 is embedded in the dielectric base 70 at a non-exposed layer position in the neighborhood of the surface of the dielectric base 70. Notwithstanding the foregoing, however, the entire portion of the first type radiation electrode 50 excluding the feeding terminal 53 thereof and the entire portion of the second type radiation electrode 61 excluding the ground connection terminal 63 thereof may be embedded in the dielectric base 70.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna comprising:

a dielectric base; and at least two radiation electrodes including a first radiation electrode that is provided on a surface of the dielectric base or embedded in the dielectric base and a second radiation electrode that is provided on the surface of the dielectric base or embedded in the dielectric base, the first radiation electrode including an open terminal at one end of the first radiation electrode and a feeding terminal at the other end of the first radiation electrode so as to constitute a monopole antenna, the second radiation electrode including a capacitive-coupling feeding electrode at one end of the second radiation electrode and a ground connection terminal at the other end of the second radiation electrode so as to constitute a capacitive feed antenna; wherein the open terminal of the first radiation electrode is located opposite to the capacitive-coupling feeding electrode of the second radiation electrode when viewed in a length direction of the dielectric base such that the open terminal of the first radiation electrode and the capacitive-coupling feeding electrode of the second radiation electrode are spaced apart from one another by a greater distance than a distance between any other portions of the first and second radiation electrodes;

the first radiation electrode and the second radiation electrode are fed independently of each other by respective feeder circuits; and the first radiation electrode includes a ground connection electrode to achieve matching, and an end of the matching ground connection electrode is connected to the ground connection terminal of the second radiation electrode.

2. The antenna according to claim 1, wherein a plane on which the open terminal of the first radiation electrode is provided is not the same as a plane on which an open end of the second radiation electrode is provided.

3. The antenna according to claim 1, wherein a cross section of the dielectric base that is taken along a vertical plane with respect to the length direction of the dielectric base has a shape substantially of a capital L or a substantially L-shaped portion.

4. The antenna according to claim 1, wherein the first radiation electrode includes two radiation electrodes that share the feeding terminal and have lengths different from each other.

5. The antenna according to claim 1, wherein the dielectric base constitutes a portion of a frame of a wireless communication apparatus on which the antenna is provided or a portion of a structural body that is provided inside the frame of a wireless communication apparatus on which the antenna is provided.

6. A wireless communication apparatus comprising:

the antenna according to claim 1; and a wireless communication circuit arranged to perform feeding via the feeding terminal and the capacitive-coupling feeding electrode.

7. The wireless communication apparatus according to claim 6, further comprising a matching circuit in one of the respective feeder circuits that is arranged to feed the capacitive-coupling feeding electrode, wherein an antenna portion of the antenna that includes the second radiation electrode is allocated to a wireless communication system that performs communications in a frequency bandwidth that is narrower than that of an antenna portion of the antenna that includes the first radiation electrode.

* * * * *